US012416461B1

(12) United States Patent
Elrod

(10) Patent No.: US 12,416,461 B1
(45) Date of Patent: Sep. 16, 2025

(54) MAGAZINE CAPACITY TRACKING SYSTEM

(71) Applicant: Jonathan Elrod, Sorrento, FL (US)

(72) Inventor: Jonathan Elrod, Sorrento, FL (US)

( * ) Notice: Subject to any disclaimer, the term of this patent is extended or adjusted under 35 U.S.C. 154(b) by 0 days.

(21) Appl. No.: 18/667,498

(22) Filed: May 17, 2024

(51) Int. Cl.
*F41A 9/62* (2006.01)
*F41A 17/38* (2006.01)

(52) U.S. Cl.
CPC ..... *F41A 9/62* (2013.01); *F41A 17/38* (2013.01)

(58) Field of Classification Search
CPC ..... F41A 9/62
See application file for complete search history.

(56) References Cited

U.S. PATENT DOCUMENTS 5,052,138 A * 10/1991 Crain ..... F41A 9/62 42/1.02
5,206,444 A 4/1993 Oliver
5,592,769 A * 1/1997 Villani ..... F41A 9/62 42/1.03
5,642,581 A 7/1997 Herold
5,799,432 A 9/1998 Wright, Sr.
7,802,391 B2 9/2010 Quinn
8,109,023 B2 2/2012 Pikielny
8,215,044 B2 7/2012 Arbouw
8,464,451 B2 6/2013 McRae
9,857,131 B1 1/2018 Rose
10,156,407 B2 12/2018 Delgado Acarreta
10,459,678 B2 10/2019 Samo
10,557,676 B2 2/2020 Masarik
10,760,864 B1 9/2020 Faughn
10,900,727 B2 * 1/2021 Masarik ..... G01D 5/12
11,466,947 B2 10/2022 Masarik
2008/0127538 A1 * 6/2008 Barrett ..... F41A 19/01 434/24
2009/0084015 A1 4/2009 Compton
2011/0162514 A1 * 7/2011 Osborne ..... F41H 13/0018 224/191
2012/0122058 A1 * 5/2012 Jensen ..... F41A 9/62 434/16
2012/0167423 A1 7/2012 Kindt
2012/0329364 A1 * 12/2012 Botten ..... F41A 33/00 446/405
2014/0311003 A1 * 10/2014 Loreman ..... F41A 9/62 42/1.02
2018/0128563 A1 * 5/2018 Righi ..... F41A 9/62
2018/0156557 A1 * 6/2018 Abbott ..... F41A 17/38
2019/0025000 A1 * 1/2019 Bascom ..... F41A 33/06
2019/0170463 A1 * 6/2019 Walther ..... F41A 9/70
(Continued)

FOREIGN PATENT DOCUMENTS

EP 1 847 793 A2 10/2007
GB 2 182 424 A 5/1987
(Continued)

*Primary Examiner* — Gabriel J. Klein
(74) *Attorney, Agent, or Firm* — Lambert Shortell & Connaughton; David J. Connaughton, Jr.; Justin P. Tinger

(57) ABSTRACT

A magazine capacity tracking and display system for a firearm is provided. The system includes a sensor within the magazine of the firearm to determine rounds remaining within the magazine. The system further includes a display unit connected to the firearm and separate from the magazine which displays a number identifying the number of rounds remaining in the magazine.

18 Claims, 7 Drawing Sheets

(56) References Cited

U.S. PATENT DOCUMENTS

| | | | | |
|---|---|---|---|---|
| 2019/0277590 | A1* | 9/2019 | Masarik | F41A 9/70 |
| 2020/0080807 | A1 | 3/2020 | Flood | |
| 2021/0148667 | A1* | 5/2021 | Boone | F41A 17/74 |
| 2021/0215446 | A1* | 7/2021 | Czarnecki | G05B 15/02 |
| 2023/0040897 | A1* | 2/2023 | Nunez | F41A 35/00 |
| 2024/0288239 | A1* | 8/2024 | Masarik | F41A 9/65 |

FOREIGN PATENT DOCUMENTS

| | | | | | |
|---|---|---|---|---|---|
| GB | 2268252 | A | * | 1/1994 | F41A 33/00 |
| GB | 2528472 | A | * | 1/2016 | F41A 9/62 |
| RU | 2758503 | C1 | * | 10/2021 | |
| WO | 2008132739 | A2 | | 11/2008 | |

* cited by examiner

MAGAZINE CAPACITY TRACKING SYSTEM

BACKGROUND OF THE INVENTION

The present disclosure relates generally to a device to identify how many rounds are remaining in a magazine of a firearm. More particularly, the present disclosure relates to a device that identifies magazine follower location, relates location to ammunition rounds remaining in the magazine, and presents this information on a display.

The prior art is surprisingly lacking in display devices that identify remaining rounds of ammunition in a magazine of a firearm. This results in firearm operators having to keep count in their heads as to bullets remaining, and/or fire until realizing that the magazine is empty and then reloading after this realization. While devices that count "shots" exist-using sensors such as audio or motion sensing, shot counting has limited applicability. If a user does not know the number of rounds in the magazine to start, shot counting is largely useless. Moreover, a user still has to do the mental math of subtracting shots counted by the counter from the expected number of rounds in the magazine, distracting the user.

Therefore, what is needed is a system which may reliably track and display the number of rounds remaining in a firearm magazine.

SUMMARY OF THE INVENTION

The subject matter of this application may involve, in some cases, interrelated products, alternative solutions to a particular problem, and/or a plurality of different uses of a single system or article.

In one aspect, a firearm magazine is provided. The magazine comprises a magazine body defining an interior space. A sensor array is positioned within the interior space, as is a magazine follower. The magazine follower has a material that can be sensed by the sensor array, so as to determine a location of the magazine follower within the interior space of the magazine body. The magazine body further defines a recessed magazine catch, with an electric contact positioned within this recessed catch. The electric contact is in electronic communication with the sensor array via, e.g. a wire.

In another aspect, a firearm is provided. Along with other components of firearms that are known in the art, the firearm has an magazine removably attached thereto. The magazine comprises a magazine body defining an interior space. A sensor array is positioned within the interior space, as is a magazine follower. The magazine follower has a material that can be sensed by the sensor array, so as to determine a location of the magazine follower within the interior space of the magazine body. The magazine body further defines a recessed magazine catch, with an electric contact positioned within this recessed catch. The electric contact is in electronic communication with the sensor array via, e.g. a wire. The magazine is removably secured to a magazine holder of the firearm by a magazine catch lever which engages in the recessed magazine catch of the magazine. This catch lever comprises one or more contacts such as contact pins which are engage with the electric contact of the magazine. A wire or other connection connects the one or more contact pins to a display unit attached to the firearm. The display unit comprises a display screen, power source, and a processor.

In yet another aspect, a firearm is provided. Along with other components of firearms that are known in the art, the firearm has a magazine removably attached thereto. The magazine has a magazine body which defines an interior space. Within the interior space is a sensor array and a magazine follower. The magazine follower can be sensed by the sensor array, such as by the follower having a material which can be sensed by the sensor array. The magazine body further defines a recessed magazine catch. An electric contact is positioned on the magazine body and is in electronic communication with the sensor array. The magazine is removably secured to a magazine holder of the firearm by a magazine catch lever which is engaged in the recessed magazine catch of the magazine. The firearm also has one or more contact pings which are engaged with the electric contact on the magazine. A wire may connect the one or more contact pins to a display unit attached to the firearm. The display unit comprises a display screen, a power source, and a processor.

DETAILED DESCRIPTION OF THE INVENTION

Figure 1:
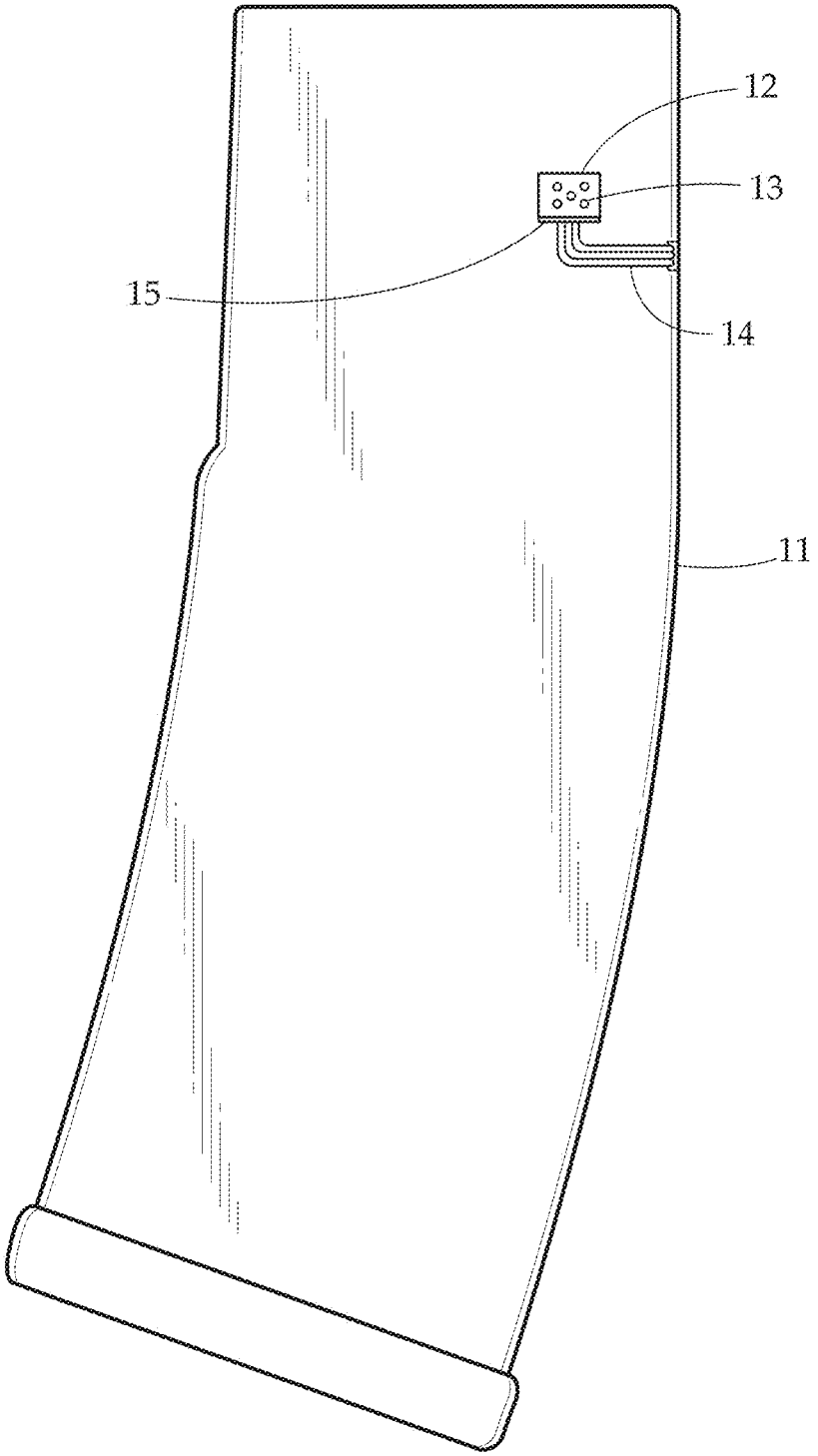
FIG. 1 provides an elevation view of an embodiment of the present disclosure.

The detailed description set forth below in connection with the appended drawings is intended as a description of presently preferred embodiments of the invention and does not represent the only forms in which the present disclosure may be constructed and/or utilized. The description sets forth the functions and the sequence of steps for constructing and operating the invention in connection with the illustrated embodiments.

Generally, the present disclosure concerns a device that shows a user how many rounds remain in a magazine of a firearm. The device includes a display portion to display rounds remaining, and a sensor portion in the magazine to sense rounds remaining in the magazine. The two portions are electrically connected. In typical embodiments, the magazine has a series of sensors, such as magnetic (halo metric) or other sensors which may be arranged down the length of the magazine. A spring loaded magazine follower within the interior space defined by the magazine has a corresponding material which may be sensed by the sensor array, and/or another sensor thereon. This configuration allows for generation of an electrical signal corresponding to the location of the follower and thus, the number of rounds remaining in the magazine. The electrical signal is conveyed to the display portion via an electrical connection. In typical embodiments, the display portion is positioned on the firearm itself, such as on a picatinny rail or the like, among other placement options. In one embodiment, electronic communication between the sensor portion, located in the magazine, and the display portion, located on the firearm may be integrated into the magazine catch on the magazine and catch lever on the firearm which engages the magazine catch. Of course, other configurations may be possible as well without straying from the scope of this disclosure. The presently disclosed system may be used on any firearm, though is generally shown and described applied to an AR-15 platform solely for the purpose of efficient disclosure.

The presently disclosed system allows the user to always know how many rounds remain in the magazine. For example, a competition shooter moving from target to target would not have to count how many rounds have been fired to know when he or she needs to eject an empty magazine and replace it with a full one. When the user reaches "zero" they would know they had an empty magazine, yet one round remaining in the chamber. The user may then replace the empty magazine with a full magazine, and continue firing at the targets without the need to reset the gun from when it holds open the chamber because the last round was dispensed. In another alternative embodiment, the display may show "zero" when the magazine is empty and there is no round in the chamber—i.e. the firearm is completely empty. Different configurations may have advantages as far as safety (zero means fully empty) vs. speed and effectiveness in competitive or combat situations (zero means magazine is empty).

As noted, there are three primary components to typical embodiments of the present disclosure. The magazine having sensors, a numerical display, an electrical contact point and connection wires for electrically connecting the magazine sensors to the numerical display portion.

The magazine has an array of sensors. These preferably are positioned on an inside of the magazine, though may be anywhere on or in the magazine. In one embodiment, the sensor array may be located on the back (user facing) side spine of the magazine. Typical magazines are formed of a plastic or polymer material, but may be formed of other materials such as metals, composites, and the like. The magazine has a body which defines an interior space in which firearm rounds are stored, along with a follower which is spring loaded and urges the rounds up and out of the magazine. In a particular embodiment, the sensors may be magnetic sensors configured to track a location of a material on the follower that can be sensed by the magnetic sensors, such as a magnet or magnetic metal positioned on the magazine follower. In other embodiments, other sensors may be used such as electromagnetic sensors, optical sensors, heat sensors, motion sensors, and the like. In a particular embodiment, the number of magnetic sensors may match the round capacity of the magazine. For example a 30 round magazine may have 30 sensors, a 20 round magazine may have 20 sensors. In magnetic sensor embodiments, a traditional spring loaded magazine follower may comprise a magnet or magnetic metal piece (or may be formed of a magnet or magnetic metal material). As such, as the follower moves upward in the magazine with the release of each subsequent round, it follows and is sensed by one of the sensors in the sensor array. An electrical signal is generated by the sensor and transmitted via wires, or the like, to the display portion. In preferred embodiments, the magazine has no power source and must be connected to the separate display portion which energizes the sensors via this electrical connection.

The magazine body defines a recessed catch into which a lever on the firearm may engage, thus holding the magazine in place to the fire arm. In some embodiments, the electric contact or contacts electrically connected to the sensor array is positioned in this catch and is also recessed from the surface of the magazine body.

The display portion involves a numerical display, such as a simple LED or LCD screen, or the like. This component may be mounted to the picatinny rail of the firearm, or otherwise mounted to the firearm. A wire or wires runs from the electrical contact on the firearm to the display. The display portion also has a body (housing) which supports the display, as well as storing a battery or other power source, and a processor which is programmed to convert the signal received from the sensor portion to a signal to provide a numerical readout on the display corresponding to the number of rounds remaining in the magazine.

Importantly, an efficient and effective contact point is required to electrically connect the removable magazine to the display portion. In one embodiment, a magazine catch lever may be modified to include electronic contact pins which engage with a magazine having an electrical contact positioned on or in the recessed catch on the magazine surface. In such an embodiment, the contact configuration ensures that there is no interference with normal operation of the firearm, it uses existing spring loaded configurations on the catch lever, which urges the pins on the catch lever into contact with the electrical contacts, and limits modifications to the existing firearms to simply replacing the original magazine catch with one having the electric contact pins.

It is notable that the present disclosure is not a shot counting device (i.e. it is not a device which counts upwards based on the number of shots fired.) Rather, it tracks that absolute number of rounds within a particular magazine. A shot counting device may track the number of rounds fired, but if a user does not know the number of rounds within the magazine to start, the shot counter is of no use as far as determining remaining rounds in the magazine. Moreover, even if a user does know the starting round number, mental math must be performed to subtract the counted shots from the known starting number. As such, the present system showing a user definitively the number of rounds remaining in the magazine has many advantages over a shot counter including ease of use and reliability of rounds remaining.

It is further notable that, in typical embodiments, there is no power source (such as a battery, etc.) within the magazine itself. Rather, the sensor array is energized by the electrical connection with the firearm and power from the display portion power source. This has a number of advantages. As is well known, batteries lose power after a certain period of time. Thus, a magazine left for a while would likely have a dead battery and thus a non-operational sensor array. Further, typical users have many magazines. Requiring a power unit for each is cumbersome and costly. Further still, magazines are regularly subjected to impact forces, rough use and handling, and the like. The more simple and resilient the sensor assembly can be, the better and more reliable the system as a whole will be. Accordingly, by using a power source of the display portion to power the sensor array of the magazine, the present system operates in a highly effective and efficient manner.

Turning now to FIG. 1, an elevation view of an embodiment of the magazine of the present system is disclosed. The magazine has a magazine "box" or body 11 which defines an interior space (not shown in this view) to house firearm rounds, as well as a spring loaded follower which urges the rounds upward and out of the magazine body 11. The magazine body 11 further defines a magazine catch 12 which is a recessed portion into which a holder on the firearm may latch into. An electrical contact or contacts 13 is, in this embodiment, seated within this magazine catch 12 recession. The contact 13 is also recessed inward from the body 11. As such, the spring loaded catch lever of a firearm (not shown), as designed in this disclosure and shown in other figures, is able to simultaneously retain the magazine to the firearm but also to electrically connect with the contact 13. A wire 14 connects the contact to the sensor array (not shown in this view). A ramp 15 is also formed by the body 11 which aids in proper placement and removal of the magazine with respect to the firearm during connection.

Figure 2:
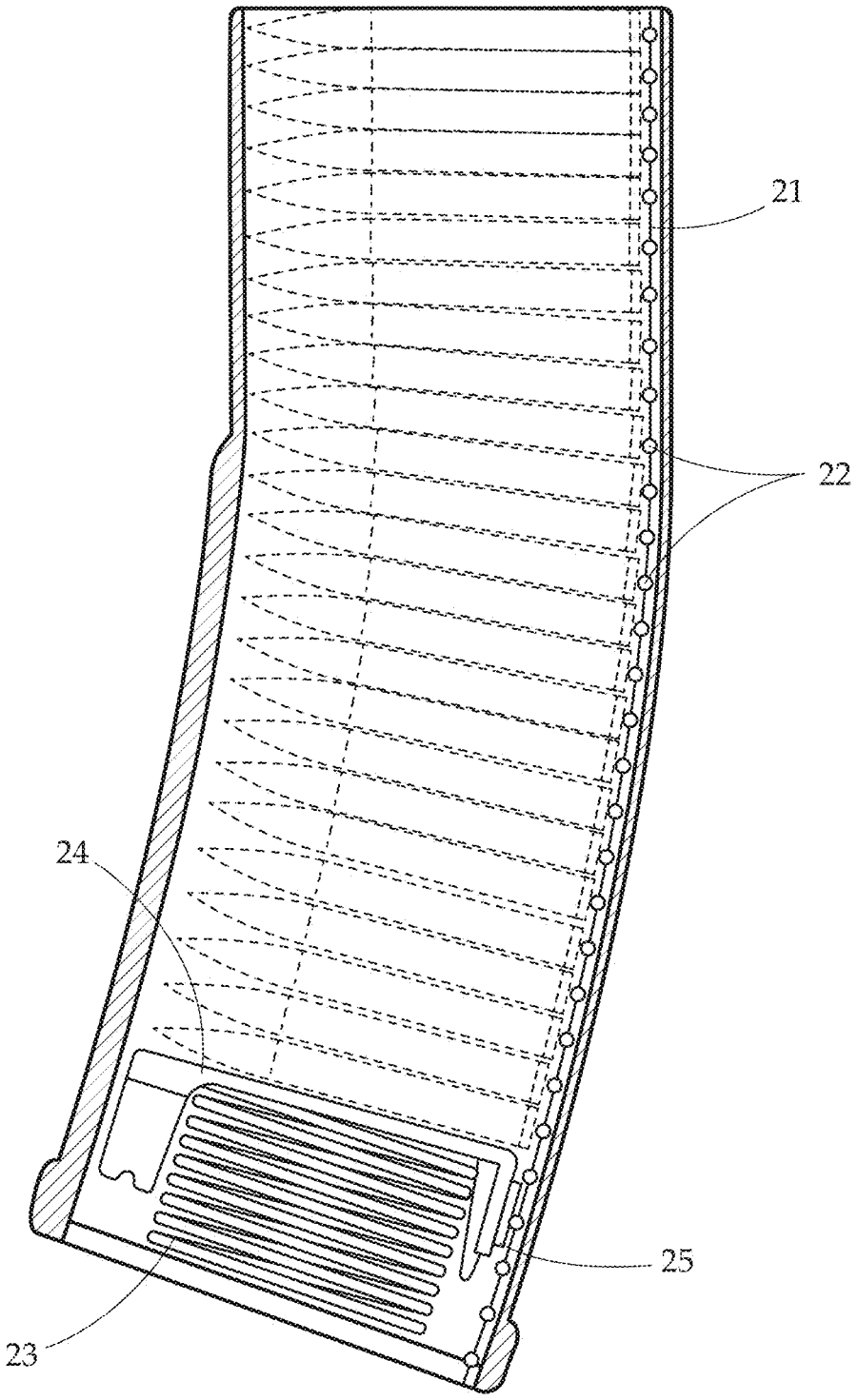
FIG. 2 provides an elevation cutaway view of an embodiment of the present disclosure.
Figure 7:
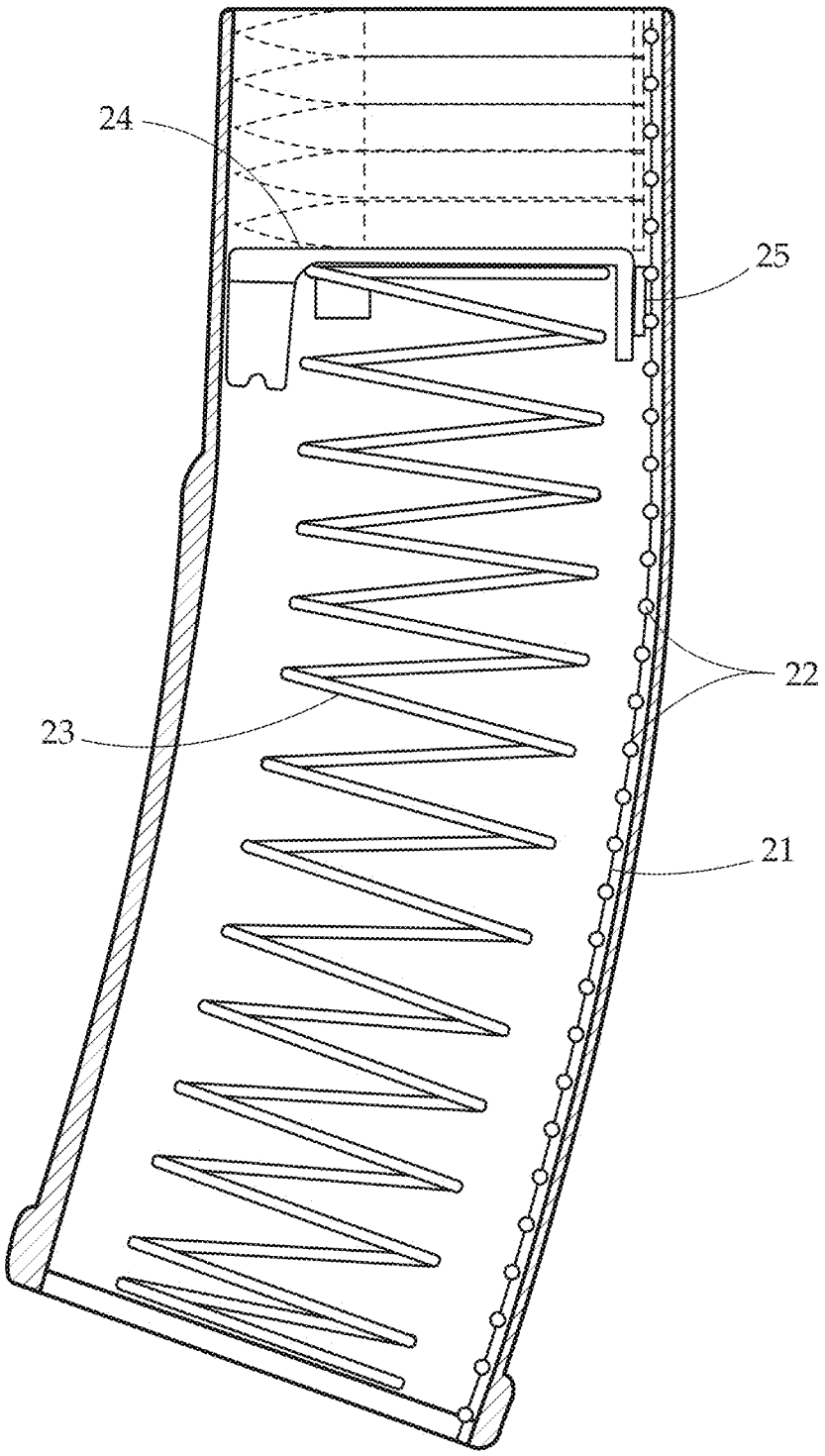
FIG. 7 provides an elevation cutaway view of another embodiment of the present disclosure.
Figure 8:
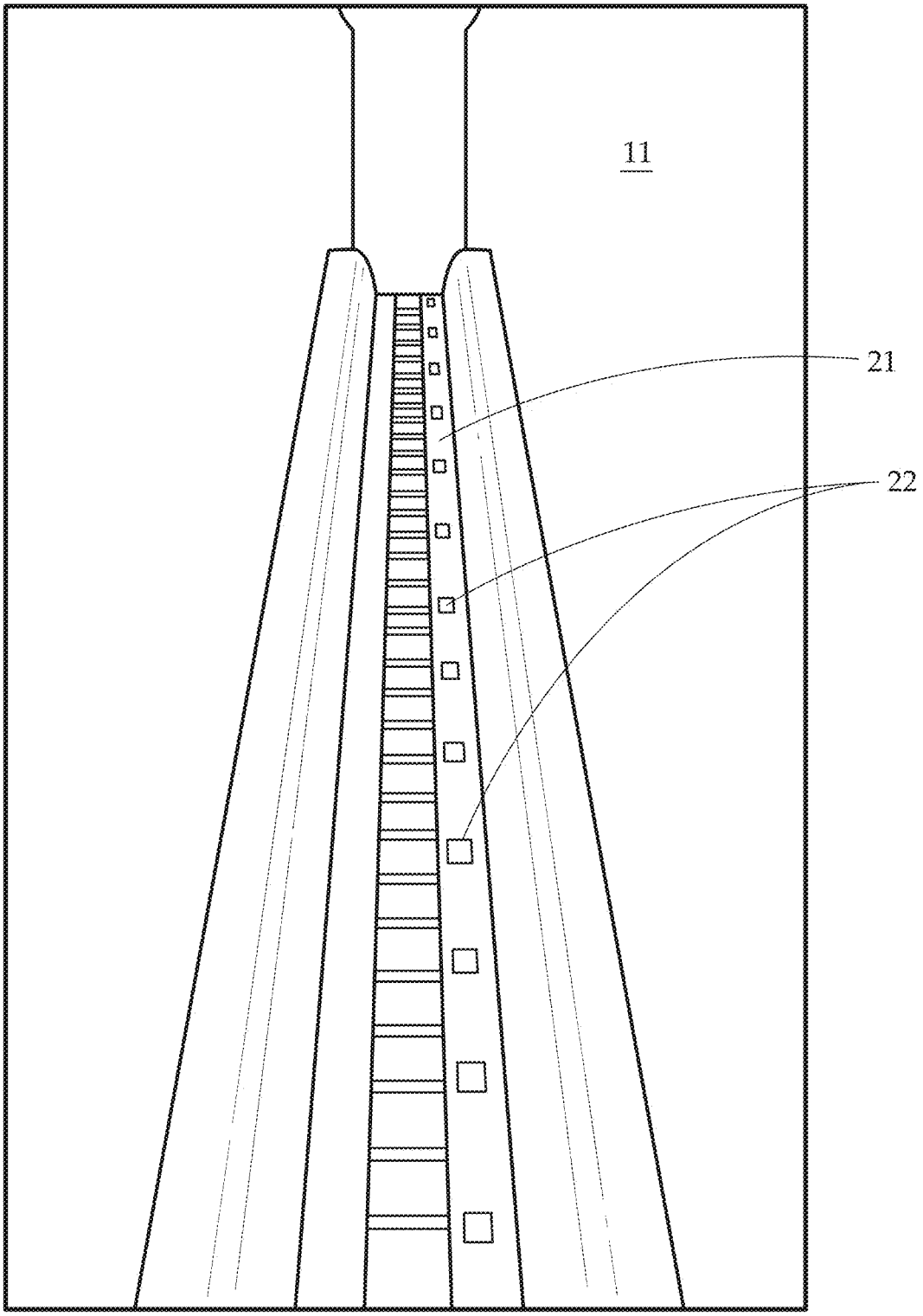
FIG. 8 provides a cross sectional side view of an embodiment of a portion of the present disclosure.

FIG. 2 shows another embodiment of the magazine in a cutaway view. In this view, a sensor array 21 shown here as a sensor strip having a plurality of sensors 22 which extend along the rear spine of the interior space of the magazine 11. In this embodiment, the sensors 22 are magnetic sensors such as halo metric sensors. Further, the sensor array 21 is arranged to have the same number of sensors 22 as number of rounds that fit in the magazine 11. In this case, thirty. A spring loaded magazine follower 24 and spring 23. The follower also has a small material 25 which can be sensed by the sensors 22 of the sensor array 21. The follower 24 moves upward within the interior space as more rounds are released from the magazine. As the follower 24 moves, its location can be sensed by the sensor array 21. More particularly, in the embodiment shown, the magnetic sensor array 21 is able to track the location of the magnet or magnetic metal 25 on the follower 24 by identifying the sensor 22 of the array that it is next to. The sensor 22 sensing the magnet or magnetic metal 25, generates an electrical signal which it transmits to the electrical contacts (13 of FIG. 1) via wire (14 of FIG. 1). As seen in FIG. 7, the follower 24 is able to move upward to engage with a different sensor 22 as it changes position. FIG. 8 provides a view inside the magazine 11 showing the interior space and sensor array 21 comprising multiple sensors 22.

Figure 3:
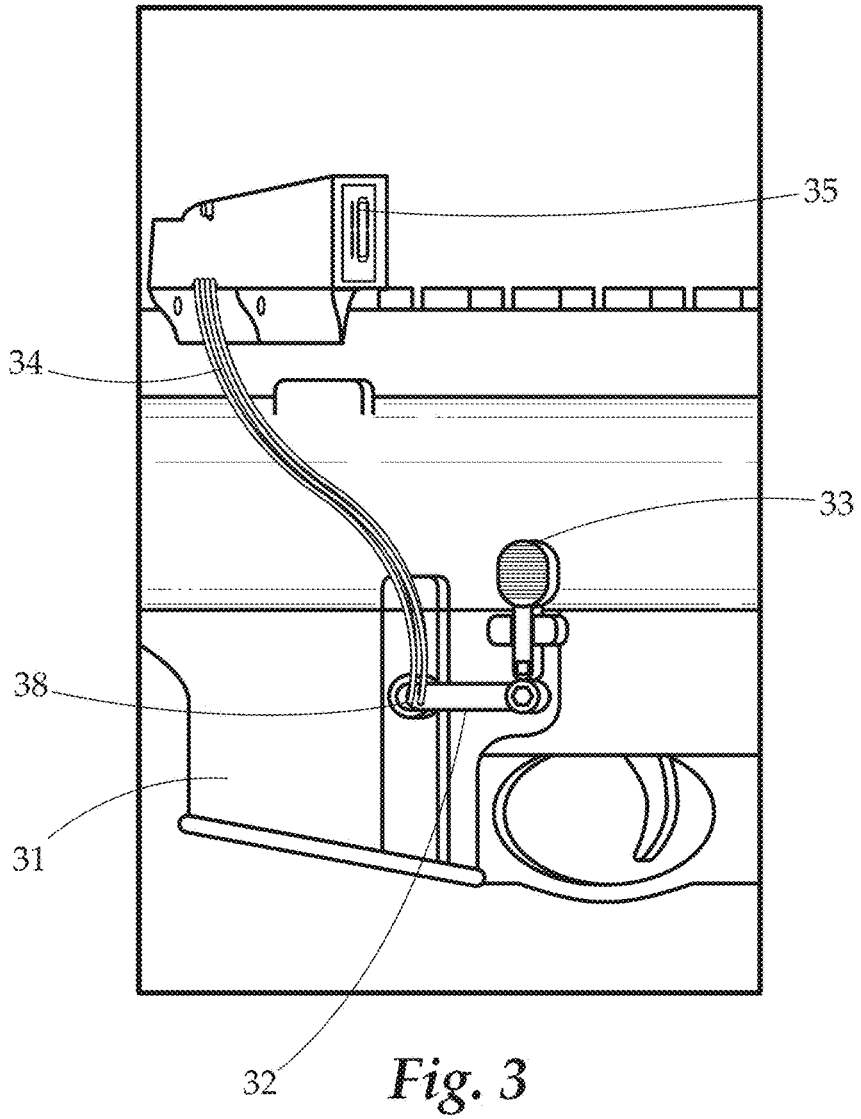
FIG. 3 provides a detail view of another embodiment of the present disclosure.
Figure 4:
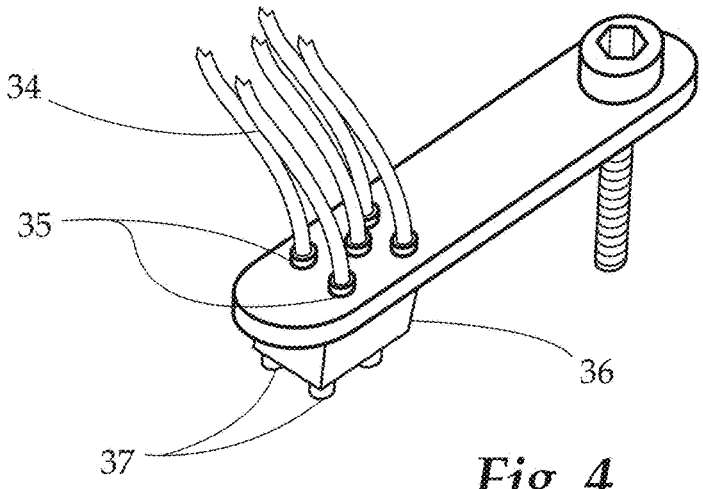
FIG. 4 provides a detail view of an embodiment of a component of the present disclosure.

FIGS. 3 and 4 provide a detail view of a portion of a firearm of the present disclosure modified to have electrical contacts and a display on the firearm. The firearm has a magazine holder 31 into which a magazine (not shown) is inserted and held. The magazine is held in place by a catch lever 32 that is spring loaded and biased in a closed position to urge a catch holder 36 into a recessed catch (12 of FIG. 1) of the magazine. The catch holder 36 protrudes from the bottom surface of the catch lever 32. In this embodiment, the catch lever 32 can be moved against the spring biased force by catch release 33. On the catch holder 36 are electric contacts 37 which are able to engage with the electric contacts 13 on the magazine. This allows the catch lever 32 to serve the dual purpose of both holding the magazine in place as well as creating the electrical communication between the display unit 35 and sensor array 21. This configuration also makes modification of an existing firearm very simple, as all one must do to retrofit an existing firearm is replace an existing prior art catch lever with the catch lever of the present disclosure. Electric contacts 36 extend, either physically or via wire to a socket 35 or similar connector, and in turn to a wire 34. The wire 34 carries signals to the visual display 38. The visual display 38 may be any structure which can provide a visible numerical output to indicate the number of rounds left in the magazine. In typical embodiments, the display 38 has a housing body which contains the display and electronics supporting it, namely a power source such as a battery and a processor programmed to receive the input from the sensor array 21 sensors 22 via contacts 13, wire 14, contacts 37, and wire 34, and convert it to a signal that causes the display to present the numerical output corresponding to number of rounds remaining in the magazine. Notably, the firearm still operates if a non-sensor equipped magazine of the prior art is inserted into the device. The display 35 will just not work but the firearm will operate normally.

Figure 5:
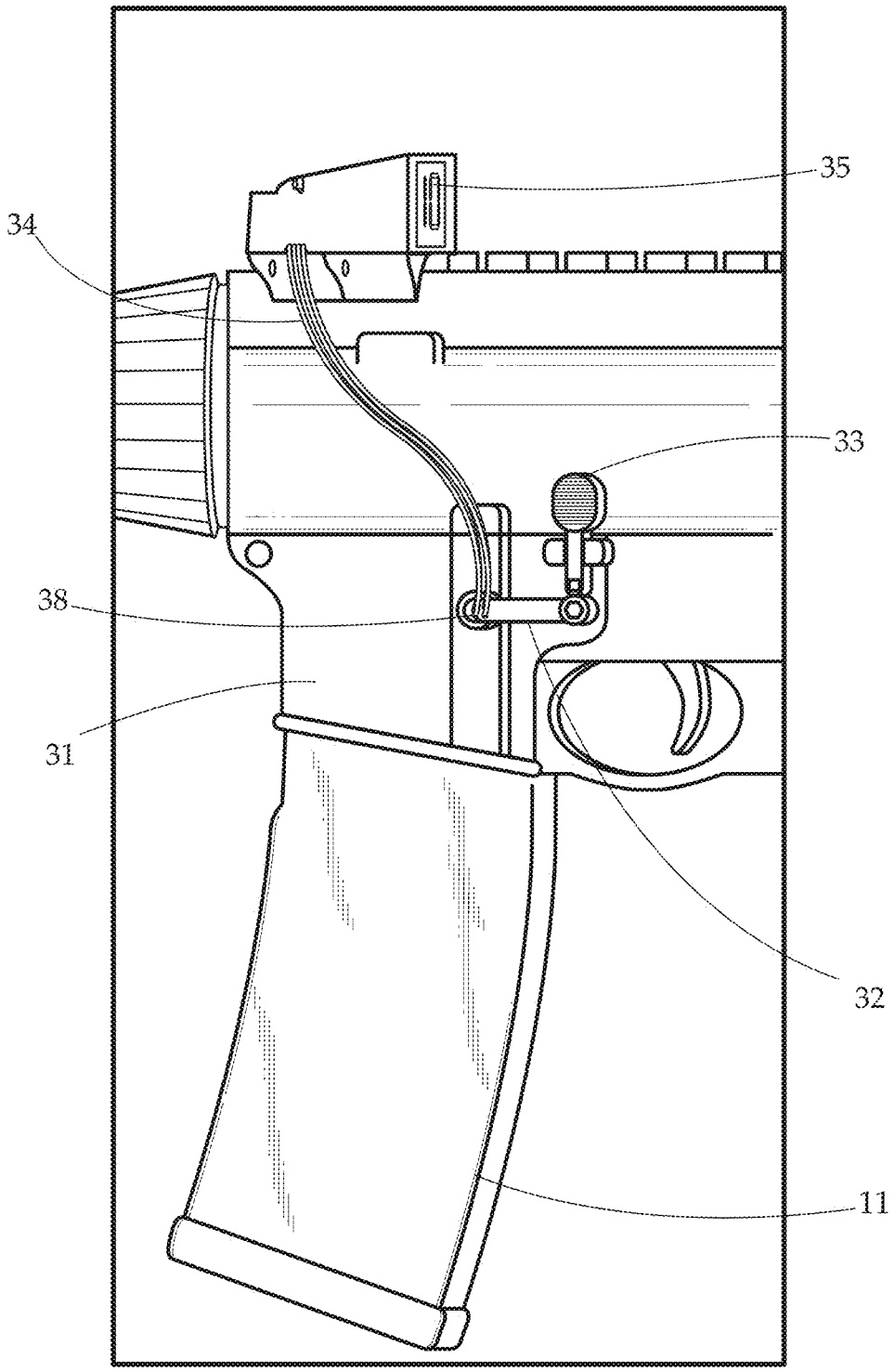
FIG. 5 provides a view of still yet another embodiment of the present disclosure.
Figure 6:
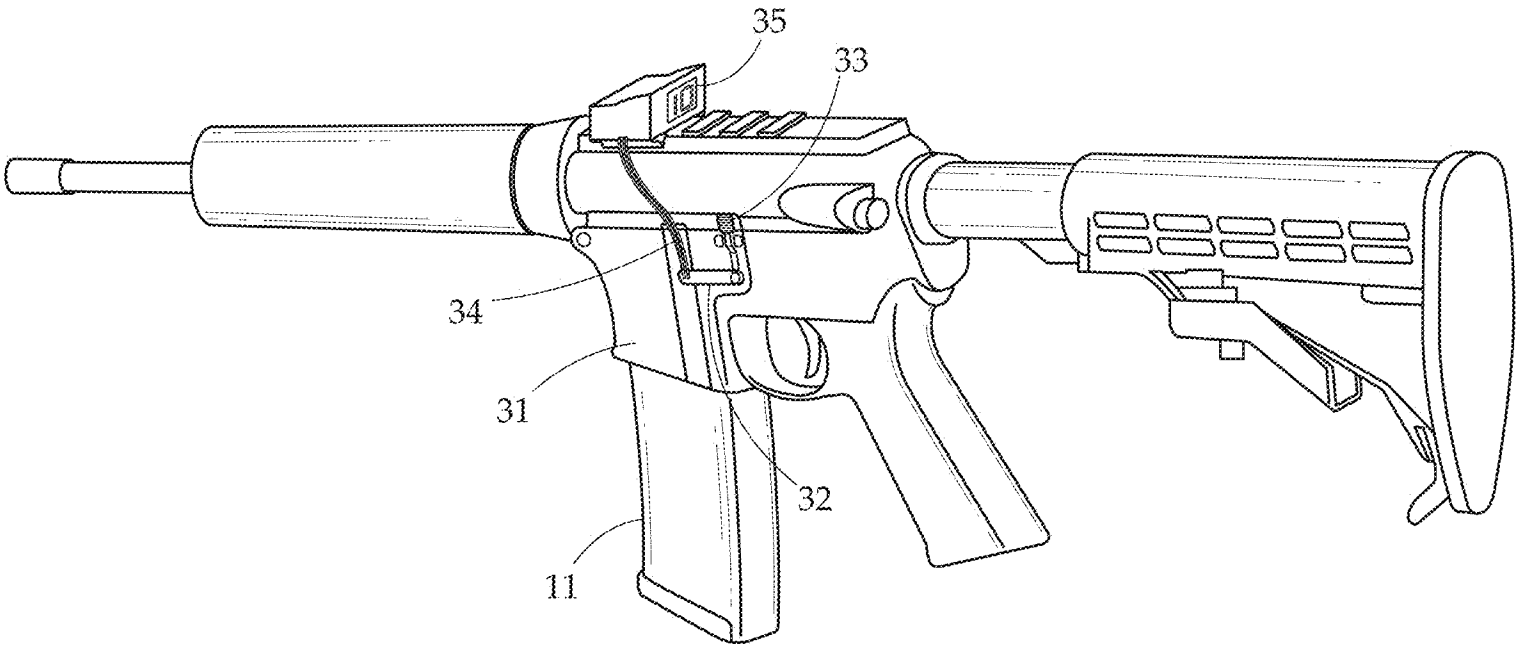
FIG. 6 provides a view of an embodiment of the present system installed on a firearm.

FIG. 5 provides a similar view to that of FIG. 3, having the magazine 11 connected thereto. As connected, the sensors 22 of the array 21 are energized by the power source of the display 38 via the electrical connection. The catch holder 36 is engaged with magazine catch 12 and contacts 37 are in physical contact with contact or contacts 13. FIG. 6 provides a view similar to that of FIG. 5, showing an embodiment of the entire firearm. In this view, an AR-15, but of course the present platform may be used on any firearm.

While several variations of the present disclosure have been illustrated by way of example in preferred or particular embodiments, it is apparent that further embodiments could be developed within the spirit and scope of the present disclosure, or the inventive concept thereof. However, it is to be expressly understood that such modifications and adaptations are within the spirit and scope of the present disclosure, and are inclusive, but not limited to the following appended claims as set forth.

What is claimed is:

1. A firearm comprising:

a magazine, the magazine comprising:

a magazine body defining an interior space;

a sensor array within the interior space of the magazine body;

a magazine follower within the interior space, the magazine follower having a material sensible by the sensor array;

the magazine body further defining a recessed magazine catch;

an electric contact positioned within the recessed magazine catch, the electric contact in electronic communication with the sensor array;

the magazine removably secured to a magazine holder of the firearm by a magazine catch lever engaged in the recessed magazine catch of the magazine;

the magazine catch lever comprising one or more contact pins engaged with the electric contact and in electronic communication with the contact and the sensor array;

a wire extending along the magazine catch lever, electrically connecting the one or more contact pins to a display unit, the display unit comprising a display screen, a power source, and a processor.

2. The firearm of claim 1 wherein the processor is operable to receive a signal from the sensor array and to cause the display screen to show a number of rounds remaining in the magazine.

3. The firearm of claim 1 wherein the display unit is mounted to a rail of the firearm.

4. The firearm of claim 1 wherein the power source of the display unit is operable to provide energy to the sensor array.

5. The firearm of claim 1 wherein the electric contact is recessed from an outer surface of the magazine body.

6. The firearm of claim 1 wherein the sensor array is a magnetic sensor array, and wherein the material sensible by the sensor array is a magnet or magnetic metal.

7. The firearm of claim 1 wherein the sensor array is operable to sense a location of the follower within the interior of the magazine, and provide a signal to the electric contact via the electronic communication between sensor array and electric contact.

8. The firearm of claim 1 wherein the magazine catch lever comprises a protruding catch holder, and wherein the one or more contact pins are on an outer surface of the catch holder.

9. The firearm of claim 1 further comprising a catch holder, the catch holder protruding from a bottom surface of the catch lever, the one or more contact pins extending from the catch holder.

10. The firearm of claim 1 further comprising a spring biasing the catch lever in a closed position, and wherein the one or more contact pins are spring loaded.

11. The firearm of claim 9 further comprising a spring biasing the catch lever in a closed position, and wherein the one or more contact pins are spring loaded.

12. The firearm of claim 9 wherein the one or more contact pins connects to the wire via a socket, the socket positioned on a top side of the catch lever, opposite to the catch holder, and the socket in electrical communication with the one or more contact pins through the catch lever and through the catch holder.

13. The firearm of claim 11 wherein the one or more contact pins connects to the wire via a socket, the socket positioned on a top side of the catch lever, opposite to the catch holder, and the socket in electrical communication with the one or more contact pins through the catch lever and through the catch holder.

14. The firearm of claim 12 further comprising a plurality of electric contacts within the recessed magazine catch, and further comprising at least two contact pins, a first of the at least two contact pins providing electrical power from the power source of the display to the sensor array via the connection of the contact pin with one of the plurality of electric contacts, and wherein a second of the at least two contact pins providing data communication between the sensor array readings and the display unit.

15. The firearm of claim 11 wherein the one or more contact pins connects directly to the wire by the wire passing through the catch lever and to the catch holder, the one or more contact pins being movable within the catch holder.

16. A firearm comprising:

a magazine, the magazine comprising:

a magazine body defining an interior space;

a sensor array within the interior space of the magazine body;

a magazine follower within the interior space, the sensor array operable to sense a position of the magazine follower within the interior space;

the magazine body further defining a recessed magazine catch;

an electric contact positioned on a surface of the magazine body, the electric contact in electronic communication with the sensor array;

the magazine removably secured to a magazine holder of the firearm by a magazine catch lever engaged in the recessed magazine catch of the magazine the magazine catch lever having a spring biasing the lever in a closed position urging it against the magazine;

the firearm comprising one or more contact pins engaged with the electric contact;

a wire connecting the one or more contact pins to a display unit, the display unit comprising a display screen, a power source, and a processor;

wherein the one or more contact pins are on the magazine catch lever;

wherein the one or more contact pins are spring loaded.

17. The firearm of claim 16 wherein the sensor array is a magnetic sensor array, and wherein the material sensible by the sensor array is a magnet or magnetic metal.

18. The firearm of claim 16 wherein the sensor array is operable to sense a location of the follower within the interior of the magazine, and provide a signal to the electric contact via the electronic communication between sensor array and electric contact.

* * * * *